United States Patent [19]

Miyaji

[11] Patent Number: 4,887,911

[45] Date of Patent: Dec. 19, 1989

[54] DEVELOPER MIXER FOR ELECTROPHOTOGRAPHIC COPYING MACHINE

[75] Inventor: Takashi Miyaji, Yamatokoriyama, Japan

[73] Assignee: Sharp Kabushiki Kaisha, Osaka, Japan

[21] Appl. No.: 253,319

[22] Filed: Sep. 30, 1988

Related U.S. Application Data

[63] Continuation of Ser. No. 120,229, Nov. 10, 1987, abandoned, which is a continuation of Ser. No. 869,326, Jun. 2, 1986, abandoned.

[30] Foreign Application Priority Data

Jun. 21, 1985 [JP] Japan ..... 60-94746

[51] Int. Cl.[4] ..... B01F 7/10; G03G 15/08

[52] U.S. Cl. ..... 366/316; 355/245; 366/328

[58] Field of Search ..... 366/279, 315, 316, 317, 366/321, 322, 324, 325, 327, 328, 343; 355/3 R, 3 DD, 245, 250, 251, 252, 253; 118/656, 657

[56] References Cited

U.S. PATENT DOCUMENTS

| | | | |
|---|---|---|---|
| 2,720,384 | 10/1955 | Gaenzle | 366/324 X |
| 4,146,323 | 3/1979 | Forward et al. | 366/324 X |
| 4,576,466 | 3/1986 | Fukuchi et al. | 355/3 DD |
| 4,583,842 | 4/1986 | Shimono et al. | 366/316 X |

*Primary Examiner*—Harvey C. Hornsby
*Assistant Examiner*—Scott J. Haugland
*Attorney, Agent, or Firm*—Flehr, Hohbach, Test, Albritton & Herbert

[57] ABSTRACT

A developer mixer for an electrophotographic copying machine comprises a shaft which is rotatably mounted in a developer tank and a plurality of fins affixed obliquely to the shaft. Each fin has a fan-shaped grooved section and the missing sections of mutually adjacent fins are at opposite directions with respect to the shaft. Each fin has a plurality of notches along the periphery such that the liquid being mixed can pass therethrough when the shaft is rotated and hence that the unfavorable effects of centrifugal force can be reduced.

2 Claims, 2 Drawing Sheets

DEVELOPER MIXER FOR ELECTROPHOTOGRAPHIC COPYING MACHINE

This is a continuation of application Ser. No. 120,229 filed Nov. 10, 1987, now abandoned, which is a continuation of application Ser. No. 869,326, now abandoned.

This invention relates to a mixing device for the developing station in an electrophotographic copying machine and more particularly to a developer mixer comprising a mixer roller rotatably mounted in a developer tank and having a plurality of fins with missing radial sections.

Figure 4:
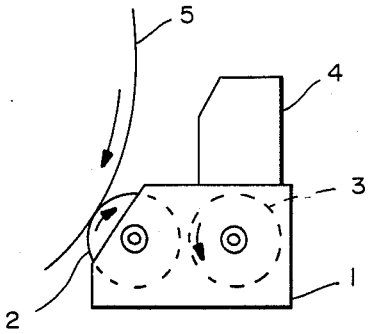
Figure 5:
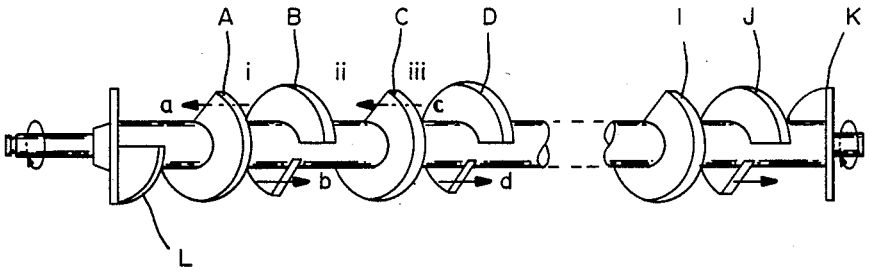

The developing station in an electrophotographic copying machine generally uses a two-component developer containing a carrier and a toner to develop a latent image formed on a photosensitive drum. As shown in FIG. 4, such a developing station typically includes a developer roller 2 and a mixer roller 3 disposed inside a tank 1 such that the toner supplied from a hopper 4 is mixed with the carrier inside the tank by the agitating motion of the mixer roller 3 and the developer thus mixed is applied to the photosensitive drum 5 by means of the developer roller 3. Since a developing station of this type includes only one mixer roller 3, such a roller must be able to efficiently mix the developer components together by rotating around its axis. During the course of research leading to the present invention, the applicant herein developed a mixing device which, as shown in FIG. 5, comprises a shaft 10 rotatably disposed inside a tank (not shown) and a plurality of fins A-L with missing radial sections attached obliquely to this shaft such that the missing sections of adjacent fins are at opposite directions with respect to the shaft but that the surfaces of the fins are mutually parallel. When the shaft 10 is rotated in the direction shown by the circular arrows, the developer liquid in the region i, for example, is pushed to the left by the second fin B and moves as shown by the arrow a through the missing radial section of the first fin A. At the same time, the portion of the liquid in the region i pushed by the first fin A moves as shown by the arrow b through the missing radial section of the second fin B. Similarly, the liquid in the region iii is either pressed by the fourth fin D and moves to the region ii along the arrow c or pushed by the third fin C and moves in the direction of the arrow d. As a result, the amount of liquid increases in the region ii but decreases in the regions i and iii. When the amount of liquid in the region ii reaches a certain level, it begins to flow over into the neighboring regions i and iii. Similar phenomena take place in the other regions along the shaft 10 as it rotates and the developer liquid becomes mixed together efficiently inside the tank.

One of the problems encountered by the mixer shown by FIG. 5 relates to the centrifugal force associated with the rotation of the shaft 10. As the shaft 10 is rotated at a fast rate, the centrifugal force on the liquid near the periphery of a fin becomes large and the liquid cannot easily return toward the shaft. In short, the shaft must be rotated faster for better mixing, but the faster the shaft is rotated, the greater becomes the centrifugal force to be overcome.

Figure 6:
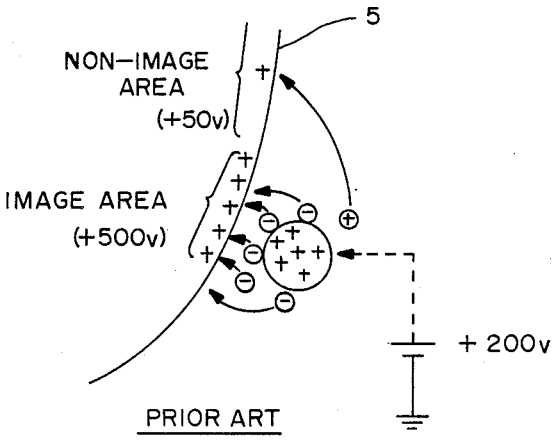

Another problem encountered by prior art mixers of this type relates to the material of which they are made. Although many developer mixers have been made of a plastic material for reasons of cost, they tend to generate oppositely charged toners by friction. Reference being made now to FIG. 6 which serves to explain this phenomenon, let us consider a photosensitive drum 5 having an image area at potential +500V and a non-image area at potential +50V. Let us further assume that the bias potential for the development is set to +200V so that a negatively charged normal toner serves to develop the image area with a potential difference of 300V. The non-image area is not developed because its potential (50V) is lower than the bias voltage (200V). If an oppositely charged (positive) toner is generated by friction between the fin and the toner, however, it will become attached to the non-image area because a potential difference greater than 150V is generated there due to the bias potential. This can cause fogginess in the result.

It is therefore an object of the present invention to provide a developer mixer for an electrophotographic copying machine which can quickly and efficiently mix the toner in a developer liquid and keep the carrier and the toner in a stably charged condition so as to prevent fogginess in the result.

The above and other objects of the present invention are achieved by providing a developer mixer comprising a shaft which is rotatably mounted in a developer tank and a plurality of metallic fins each with a notched periphery and a missing radial section attached obliquely to the shaft such that the missing radial sections of adjacent fins are at opposite directions with respect to the shaft. Since the fins are made of a metallic material, electrostatic charging takes place inside the tank only between the carrier and the toner. Since there is no charging between the toner and the fins, there is no generation of oppositely charged toners and hence a clear image without fogginess can be obtained. The notches provided at the peripheries of the fins serve to reduce the effects of centrifugal forces in the peripheral regions of the fins and thereby prevent the reduction in the rate of flow of the developer liquid toward the shaft. The notches at the peripheries of the fins further serve to provide twisting forces on the liquid and this has the effect of improving the efficiency of mixing. In short, the shaft can be rotated at a faster rate without incurring disadvantageous effects encountered in the case of a previously developed mixer shown in FIG. 5.

Figure 1:
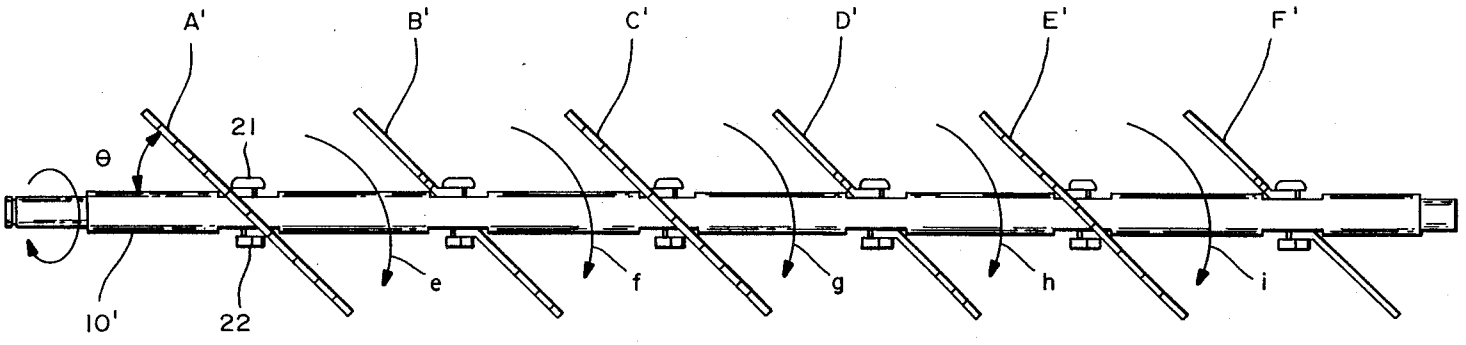
Figure 3:
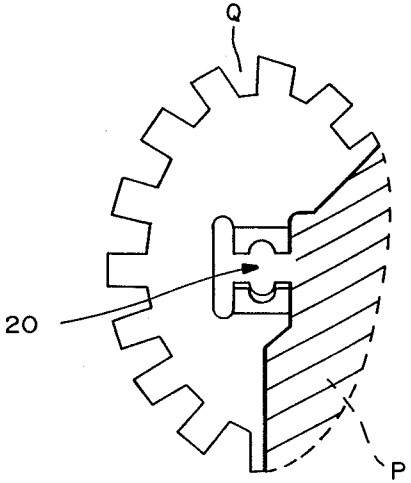
Figure 2:
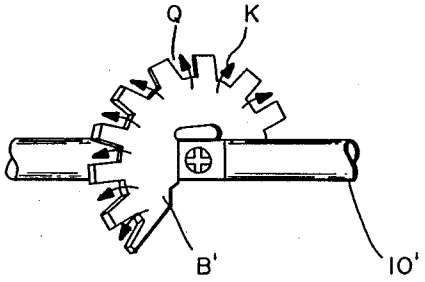

The accompanying drawings, which are incorporated in and form a part of the specification, illustrate an embodiment of the present invention and, together with the description, serve to explain the principles of the invention. In the drawings:

FIG. 1 is a front view of a developer mixer according to an embodiment of the present invention, FIG. 2 is a top view of a portion of the mixer of FIG. 1 around the fin B', FIG. 3 is a front view of one of the fins, FIG. 4 is a drawing showing the position of a developing station incorporating the mixer of this invention with respect to the photosensitive drum of an electrophotographic copying machine of which this developing station is a part, FIG. 5 is a side view of a developer mixer developed prior to the present invention, and FIG. 6 is a drawing showing the problem of fogginess encountered with a prior art developer mixer in an electrophotographic copying machine.

Reference being made to FIGS. 1 and 2, there is shown a developer mixer according to one embodiment of the present invention having a total of six fins A'-F' and a shaft 10'. The shaft 10' is supported at both ends by side walls of a developer tank (not shown) and the left-hand end is connected to a driving means which causes the shaft 10' to rotate in the direction indicated by a circular double arrow. Each fin is shaped as shown in FIG. 3, being an approximately elliptical metal plate with a radially extending portion P removed and having a plurality of notches Q along the periphery. At the center is a connecting section 20 for attaching the fin to the shaft 10' obliquely at an angle $\theta$ as shown in FIG. 1 by means of a screw 21 and a nut 22. FIG. 1 also shows that the fins are attached to the shaft 10' in such ways that the removed portions P of adjacent fins are at opposite directions with respect to the shaft 10'

When the shaft 10' rotates in the direction of the circular arrow in FIG. 1, the portions of the developer liquid between the fins move as a whole as explained above in connection with FIG. 5, or as shown by the arrows e-i. With reference to FIG. 2, however, portions of the liquid at the periphery of the fin B' move in the directions of the arrows k. In other words, portions of the liquid in this region flow through the notches Q into the region between the fins A' and B, Similarly, a portion of the liquid in the peripheral region of the fin C' flows into the region between the fins B' and C' Phenomena similar to these occur with respect to all fins, and this means that these portions of liquid are not forced to move away from the shaft 10' by centrifugal force and hence that the liquid can be mixed together efficiently. Moreover, portions of the liquid flowing through the notches Q as shown by the arrows k experience a twisting force by the rotation of the obliquely mounted fin and this has the effect of more efficiently mixing the liquid. In short, the liquid in the tank is subjected to a very complicated combination of forces and hence becomes mixed together efficiently without being forced to move away from the shaft by centrifugal force. Since the fins A'–F' are made of a metallic material, furthermore, there is no electric charging by friction between the fins and the toner or the carrier. This additionally has the favorable effect of preventing the generation of oppositely charged toners.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the number of fins to be attached to the shaft does not limit the invention. Such modifications and variations that may be apparent to a person skilled in the art are intended to be included within the scope of this invention.

What is claimed is:

1. A developer mixer comprising a shaft rotatably mounted in a developer tank and a plurality of planar fins each having a generally fanshaped grooved section, said fins being mutually parallel and affixed to said shaft obliquely, said grooved sections of each mutually adjacent pair of said fins being at opposite directions with respect to said shaft, each of said fins having a plurality of notches along the periphery thereof.

2. The developer mixer of claim 1 wherein said fins are made of a metallic material.

* * * * *